US009689596B2

(12) United States Patent
Agorichas

(10) Patent No.: US 9,689,596 B2
(45) **Date of Patent: *Jun. 27, 2017**

(54) SYSTEM AND METHOD FOR CLEANING REFRIGERATION COILS AND THE LIKE

(71) Applicant: Thomas J. Agorichas, Michigan City, IN (US)

(72) Inventor: Thomas J. Agorichas, Michigan City, IN (US)

( * ) Notice: Subject to any disclaimer, the term of this patent is extended or adjusted under 35 U.S.C. 154(b) by 785 days.

This patent is subject to a terminal disclaimer.

(21) Appl. No.: 14/066,528

(22) Filed: Oct. 29, 2013

(65) Prior Publication Data

US 2014/0075709 A1 Mar. 20, 2014

Related U.S. Application Data

(62) Division of application No. 13/486,362, filed on Jun. 1, 2012, now Pat. No. 8,590,100.

(60) Provisional application No. 61/610,662, filed on Mar. 14, 2012.

(51) Int. Cl.

| | |
|---|---|
| ***A47L 9/02*** | (2006.01) |
| ***F25B 47/00*** | (2006.01) |
| ***B08B 9/023*** | (2006.01) |
| ***B08B 5/02*** | (2006.01) |
| ***B08B 15/00*** | (2006.01) |
| ***B08B 15/04*** | (2006.01) |

(52) U.S. Cl.

CPC ..... *F25B 47/00* (2013.01); *A47L 9/02* (2013.01); *B08B 5/02* (2013.01); *B08B 9/023* (2013.01); *B08B 15/00* (2013.01); *B08B 15/04* (2013.01)

(58) Field of Classification Search

CPC . F25B 47/00; B08B 5/02; B08B 15/00; B08B 15/04; B08B 9/023

IPC ..... A47L 9/02

See application file for complete search history.

(56) References Cited

U.S. PATENT DOCUMENTS

| | | | |
|---|---|---|---|
| 3,510,905 | A | 5/1970 | Bannert |
| 3,964,123 | A | 6/1976 | Pettersson |
| 3,978,547 | A | 9/1976 | Lawson |
| 4,865,401 | A | 9/1989 | Jacobson |
| 4,928,348 | A | 5/1990 | Clayton |
| 5,894,630 | A | 4/1999 | Bitner et al. |
| 6,866,888 | B2 | 3/2005 | Baker et al. |
| 7,132,017 | B2 | 11/2006 | Laurence |
| 7,624,470 | B2 | 12/2009 | Heyman |
| 7,987,548 | B1 | 8/2011 | Hays |
| 2004/0065107 | A1 | 4/2004 | Bas et al. |
| 2006/0254021 | A1 | 11/2006 | McRedmond et al. |
| 2007/0101534 | A1 | 5/2007 | Maier et al. |
| 2008/0022481 | A1 | 1/2008 | Reeves |
| 2010/0236577 | A1 | 9/2010 | Yoo |
| 2010/0326470 | A1 | 12/2010 | Seippel |
| 2011/0284034 | A1 | 11/2011 | Caneer |

*Primary Examiner* — David Redding

(74) *Attorney, Agent, or Firm* — Ice Miller LLP

(57) ABSTRACT

Systems and methods are described herein for cleaning objects, such as refrigeration coils and the like, by placing a first end of a bag over one side of the coils, and placing a second end of the bag over a suction hose of a vacuum. When the vacuum is activated and compressed air (or other gas or liquid) is blown into a second, opposite, side of the refrigeration coils, the dirt removed therefrom is directed toward the interior of the bag and into the vacuum and contained therein. Baffles within the bag direct the flow of dirt and debris toward the vacuum.

24 Claims, 7 Drawing Sheets

SYSTEM AND METHOD FOR CLEANING REFRIGERATION COILS AND THE LIKE

CROSS-REFERENCE TO RELATED APPLICATIONS

The present application is related to and claims the priority benefit of U.S. Nonprovisional patent application Ser. No. 13/486,362, filed Jun. 1, 2012, which is related to and claims priority of, Provisional Patent Application No. 61/610,662, filed Mar. 14, 2012, the text and drawings of which are hereby incorporated by reference in their entireties.

TECHNICAL FIELD OF THE INVENTION

The present invention generally relates to cleaning devices and, more particularly, to a system and method for cleaning refrigeration coils and the like.

BACKGROUND OF THE INVENTION

As is known in the art, refrigeration units utilize coils through which is circulated a refrigerant, typically a liquid refrigerant. Air to be cooled is directed over the coils, and an air-to-liquid heat exchange takes place, drawing heat out of the air stream and into the refrigerant liquid within the coils. Such refrigeration coils are used in a great variety of refrigeration and freezing units. Over time, dirt and other debris entrained in the stream of air will precipitate out and collect on the refrigeration coils, forming an insulator over the refrigeration coils and reducing their effectiveness in the heat transfer process. It is therefore desirable to clean the coils on a periodic basis.

Cleaning the refrigeration coils normally comprises blowing compressed air or nitrogen across the coils in order to physically dislodge the dirt from the coils and remove it from the spaces between the coils and their associated heat sink fins. This is a very messy process, as the air blows the dirt into the surrounding environment. Because the refrigeration coils are normally located in a home or place of business where it is desired to keep the area surrounding the coils clean, blowing dirt into the surrounding area is undesirable. In order to mitigate the amount of mess that is created, many technicians will place a wet rag over the end of coil opposite the source of compressed air in order to catch the dust, which is not a very effective process and never catches all of the dirt. It is furthermore necessary to repeatedly clean the rag with water and ring it out in order to keep it clean enough to catch dirt. Many technicians do not clean the refrigeration coil thoroughly due to the time required and the mess caused by doing so, as the mess created may anger customers and lead to complaints. Some technicians simply brush off the front of coil, which does not clean the inside of the coil and leaves most of the performance-robbing dirt in place.

It will be appreciated then that there remains a need in the art for improvements in existing systems and methods for cleaning refrigeration coils and the like. The present invention is directed to satisfying this need.

SUMMARY OF THE DISCLOSED EMBODIMENTS

Systems and methods are described herein for cleaning objects, such as refrigeration coils and the like, by placing a first end of a bag over one side of the coils, and placing a second end of the bag over a suction hose of a vacuum. When the vacuum is activated and compressed air (or other gas or liquid) is blown into a second, opposite, side of the refrigeration coils, the dirt removed therefrom is directed toward the interior of the bag and into the vacuum and contained therein. Baffles within the bag direct the flow of dirt and debris toward the vacuum.

In one embodiment, an apparatus for cleaning an object is disclosed, comprising: a bag having a first open end, a center section, and a second open end; a first coupler at said first open end and operative to couple said first open end to said object; a second coupler at said second open end and operative to couple said second open end to a vacuum source; and at least one baffle disposed inside said center section, wherein said at least one baffle forms a plurality of chambers within said bag.

In another embodiment, an apparatus for cleaning an object is disclosed, comprising: a bag having a first open end, a center section, and a second open end; a stiffener coupled to said bag; a first coupler at said first open end and operative to couple said first open end to said object; and a second coupler at said second open end and operative to couple said second open end to a vacuum source.

Other embodiments are also disclosed.

DETAILED DESCRIPTION OF THE DISCLOSED EMBODIMENTS

Figure 1:
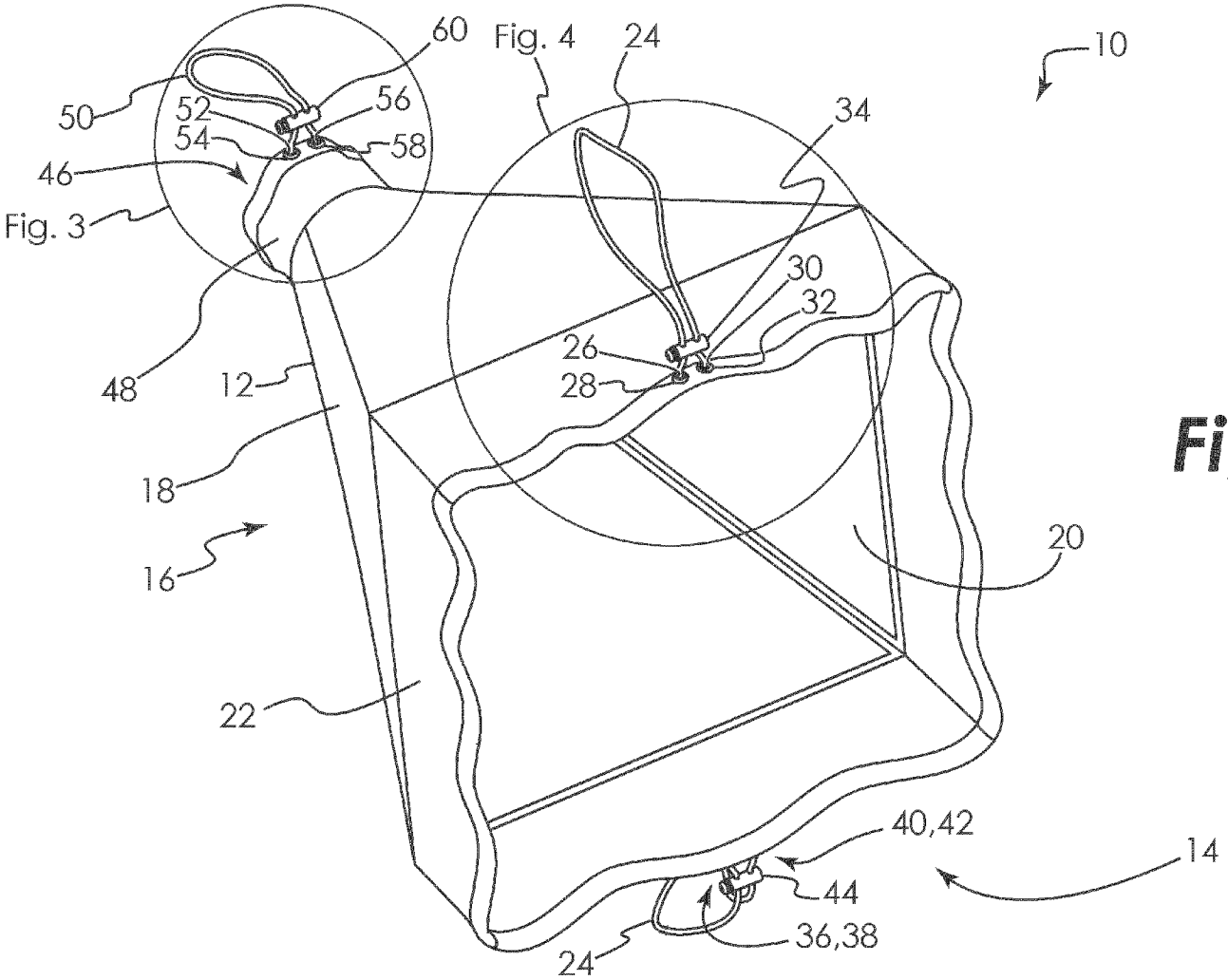
FIG. 1 is a perspective view of a first embodiment cleaning device according to the present invention.

For the purposes of promoting an understanding of the principles of the invention, reference will now be made to the embodiment illustrated in the drawings, and specific language will be used to describe that embodiment. It will nevertheless be understood that no limitation of the scope of the invention is intended. Alterations and modifications in the illustrated device, and further applications of the principles of the invention as illustrated therein, as would normally occur to one skilled in the art to which the invention relates are contemplated, are desired to be protected. Such alternative embodiments require certain adaptations to the embodiments discussed herein that would be obvious to those skilled in the art.

The presently disclosed embodiments provide a bag to be used when cleaning objects, such as refrigeration coils or other items. In some embodiments, the bag is generally shaped as a funnel, with one end sized to attach to one side of the refrigeration coils or other item to be cleaned, and the other end sized to attach to a vacuum source. Compressed air (or other gas or liquid) is blown across the refrigeration coils and dislodges dirt and debris therefrom. The bag captures dirt forced from the refrigeration coils and directs it toward the vacuum source. In some embodiments, the vacuum source is a wet or dry shop vacuum. This allows the coils to be properly cleaned and maintained without transferring the dirt to the area surrounding the coils. It will be appreciated by those skilled in the art after reviewing the present disclosure that the presently disclosed embodiments could also be used to clean other items besides refrigeration coils, although the invention has particular application in this area.

A first embodiment device is illustrated in FIG. 1 and indicated generally at 10. The device comprises a bag 12 formed from a sturdy material, such as 10 oz. cotton duck cloth to name just one non-limiting example. A first end 14 of the bag 12 is sized to fit over a predetermined range of sizes of refrigeration coil units (not shown). In the first embodiment, the first end 14 is formed in a square shape with each side measuring approximately 20 inches. Other embodiments utilize other shapes and/or dimensions as appropriate for the item to be cleaned. In the first embodiment, the center section 16 of the bag 12 is formed from four panels 18 of duck cloth that are sewn together to form a four sided funnel. In one embodiment, the cloth for each panel 18 is cut one inch wider than the finished dimensions in order to allow for a one inch seam on each joining edge. In some embodiments, a stiffener is provided by sewing (or otherwise attaching) a stiff or somewhat stiff liner 20 to each of the panels 18. Liner 20 may be made from 20 gauge vinyl, to name just one non-limiting example. In some embodiments, the liners 20 are interior to the bag 12, and in other embodiments the liners 20 are exterior to the bag 12. The liner 20 helps maintain the shape of the funnel and keeps the bag 12 from collapsing in on itself under the vacuum pressure and allows the dirt, debris, water and/or coil cleaning solutions to slide smoothly though the bag and into the vacuum.

Figure 4:
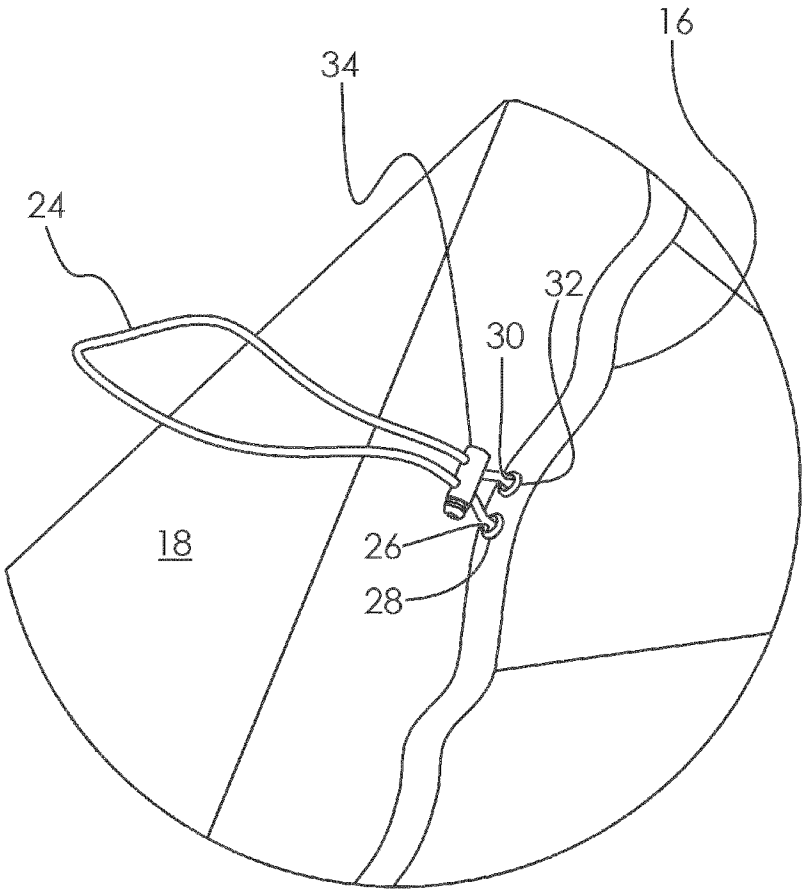
FIG. 4 is a close-up view of another portion of FIG. 1.

The first end 14 of the device 10 includes a first coupler 22 for attaching the device 10 to a refrigeration coil (or other device) to be cleaned. In the illustrated embodiment, the coupler 22 is integral to the panels 18. In other embodiments, the first coupler 22 is formed from the same material used to form the panels 18 and is sewn to the ends of the panels 18. The coupler 22 includes an interior passage (not shown) therethrough, through which a cord 24 passes. The cord 24 exits the passage through opening 26, which may be formed by a grommet 28, and re-enters the passage through an opening 30, which may be formed by a grommet 32. The cord 24 encircles the entire opening of the first end 14, such that when the cord 24 is pulled, it will cinch down the opening of the first end 14. An optional two-holed drum cord stop 34 (such as those available from Best Buy Button & Buckle Int'l Ltd., 1715 Durklyn Ct., San Marino, Calif. 91108, USA) may be placed over the cord 24 in order to lock the cord 24 in any desired position, such as when the cord 24 has been used to cinch the opening at the first end 14 around an item to be cleaned. This arrangement is shown in greater detail in FIG. 4. In some embodiments, the cord 24 exits the first coupler 22 at two locations as shown in FIG. 1, exiting out of opening 36, which may be formed by a grommet 38, and re-entering the passage through opening 40, which may be formed by a grommet 42. A second drum cord stop 44 may be provided to lock this end of the cord 24 in any desired position.

With this or a similar arrangement, the first end 14 opening may be placed over the refrigeration coil unit and then held securely thereto by pulling on the cinch cord 24 to tighten the first end around the refrigeration coil unit. The drum cord stops 24 and/or 44 may be engaged to keep the cord 24 cinched in this position, thereby ensuring that the device 10 stays securely fastened to the refrigeration coils while they are being cleaned. Using a coupler 22 formed with 20 inch sides, coils up to 18"×18" may be easily accommodated. Those skilled in the art will recognize from the present disclosure that the bag may be made in any dimension to accommodate any size refrigeration coil or other item to be cleaned.

Figure 3:
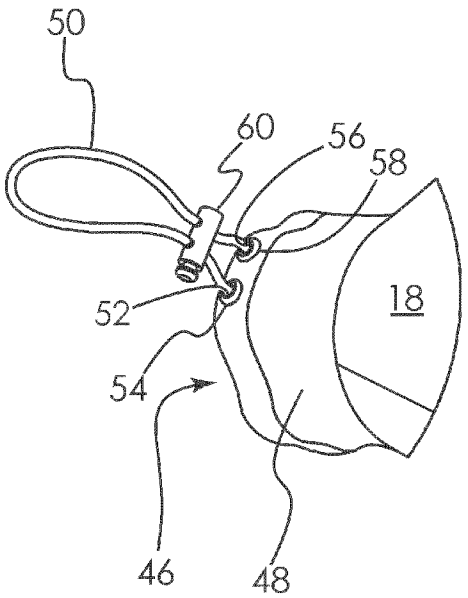
FIG. 3 is a close-up view of one portion of FIG. 1.
Figure 5:
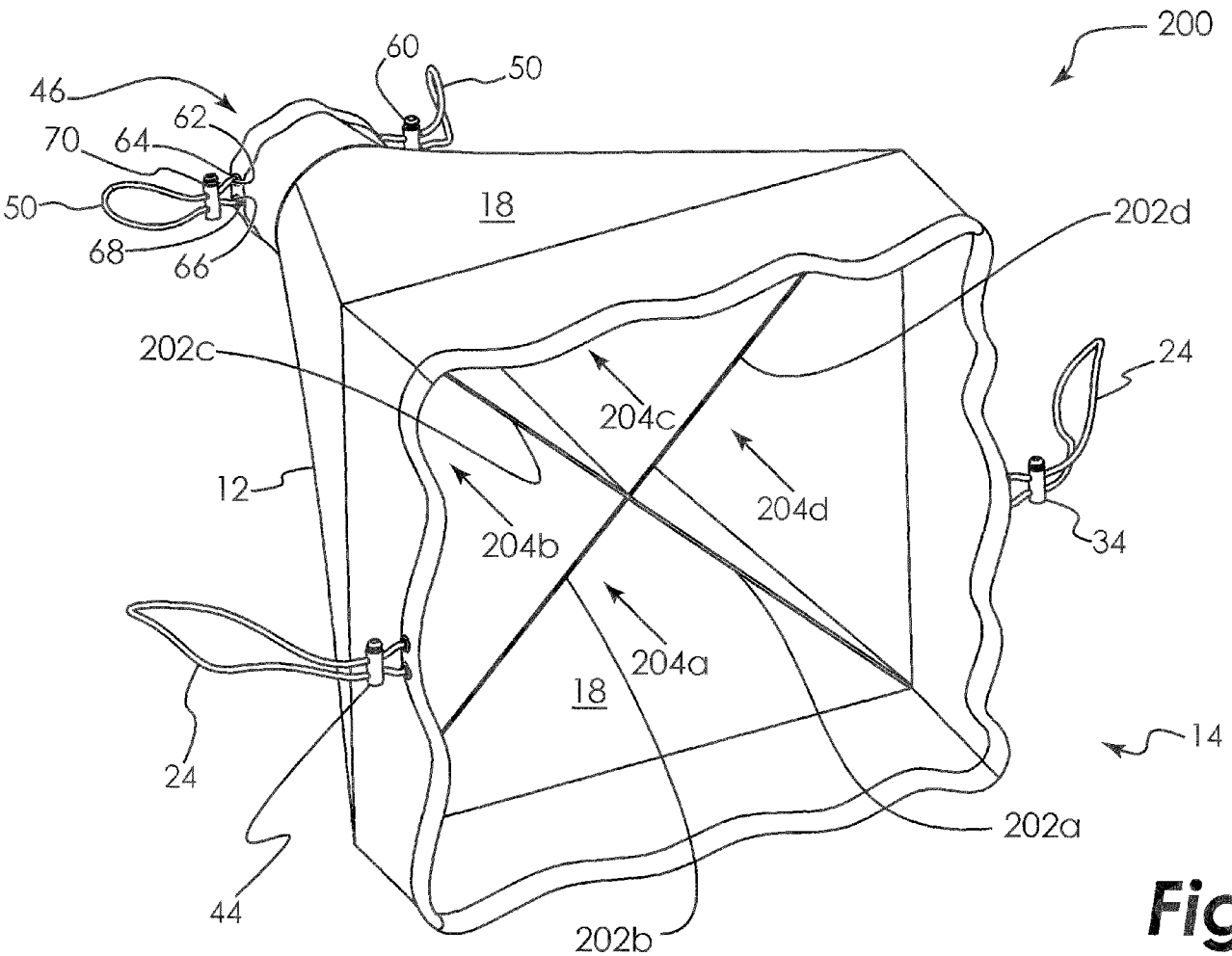
FIG. 5 is a perspective view of a third embodiment cleaning device according to the present invention.
Figure 6:
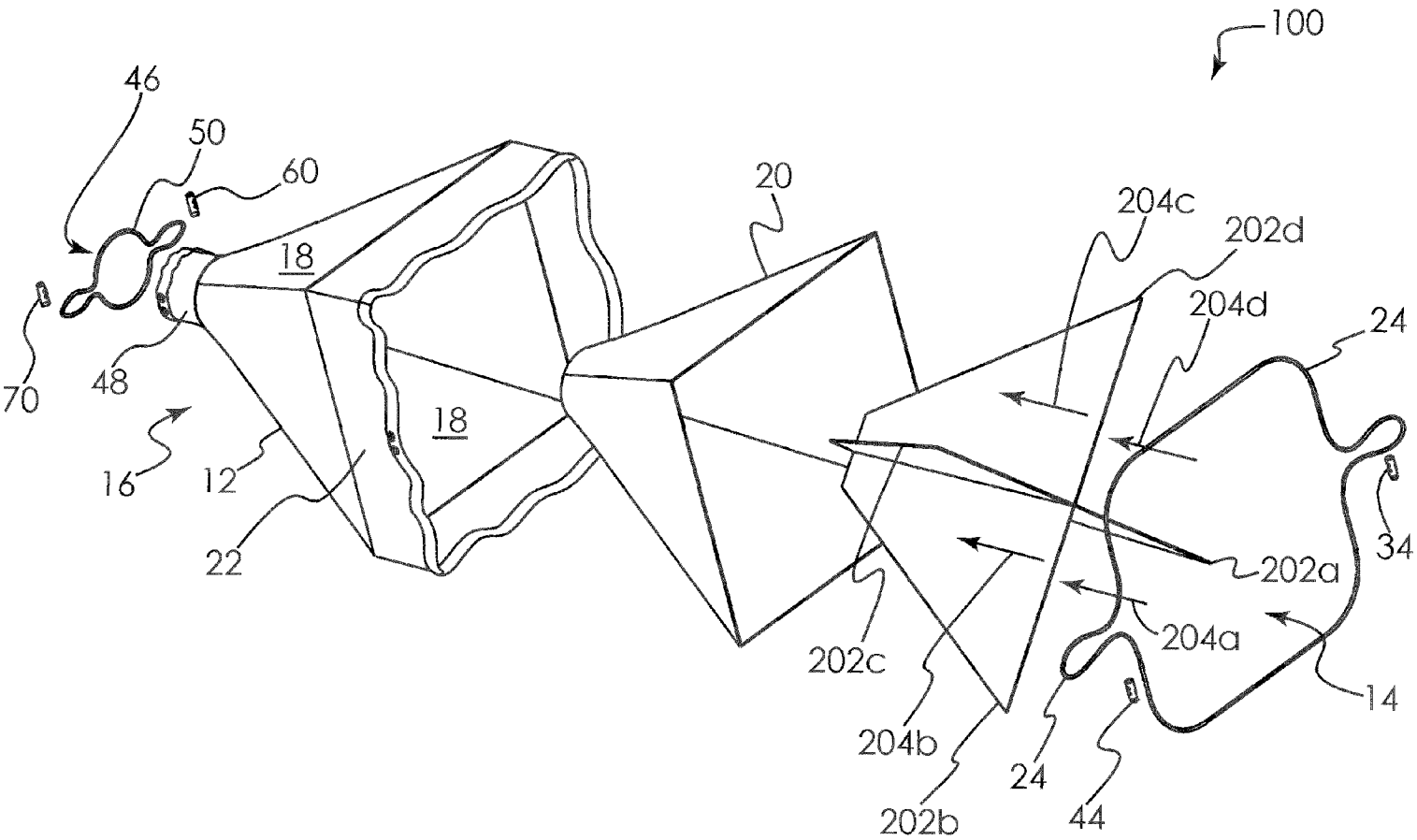
FIG. 6 is an exploded view of the third embodiment cleaning device of FIG. 5.

The second end 46 of the bag is similarly configured, but is sized to conveniently attach to a source of vacuum, such as a wet or dry shop vacuum by means of the second coupler 48. In the illustrated embodiment, the coupler 48 is integral to the panels 18. In other embodiments, the second coupler 48 is formed from the same material used to form the panels 18 and is sewn to the ends of the panels 18. The coupler 48 includes an interior passage (not shown) therethrough, through which a second cord 50 passes. The cord 50 exits the passage through opening 52, which may be formed by a grommet 54, and re-enters the passage through an opening 56, which may be formed by a grommet 58. The cord 50 encircles the entire opening of the second end 46, such that when the cord 50 is pulled, it will cinch down the opening of the second end 46. An optional two-holed drum cord stop 60 (such as those available from Best Buy Button & Buckle Int'l Ltd., 1715 Durklyn Ct., San Marino, Calif. 91108, USA) may be placed over the cord 50 in order to lock the cord 50 in any desired position, such as when the cord 50 has been used to cinch the opening at the second end 46 around a vacuum cleaner hose. This is shown in greater detail in FIG. 3. In some embodiments, the cord 50 exits the first coupler 48 at two locations as shown in FIGS. 5-6, exiting out of opening 62, which may be formed by a grommet 64, and re-entering the passage through opening 66, which may be formed by a grommet 68. A second drum cord stop 70 may be provided to lock this end of the cord 50 in any desired position.

Figure 2:
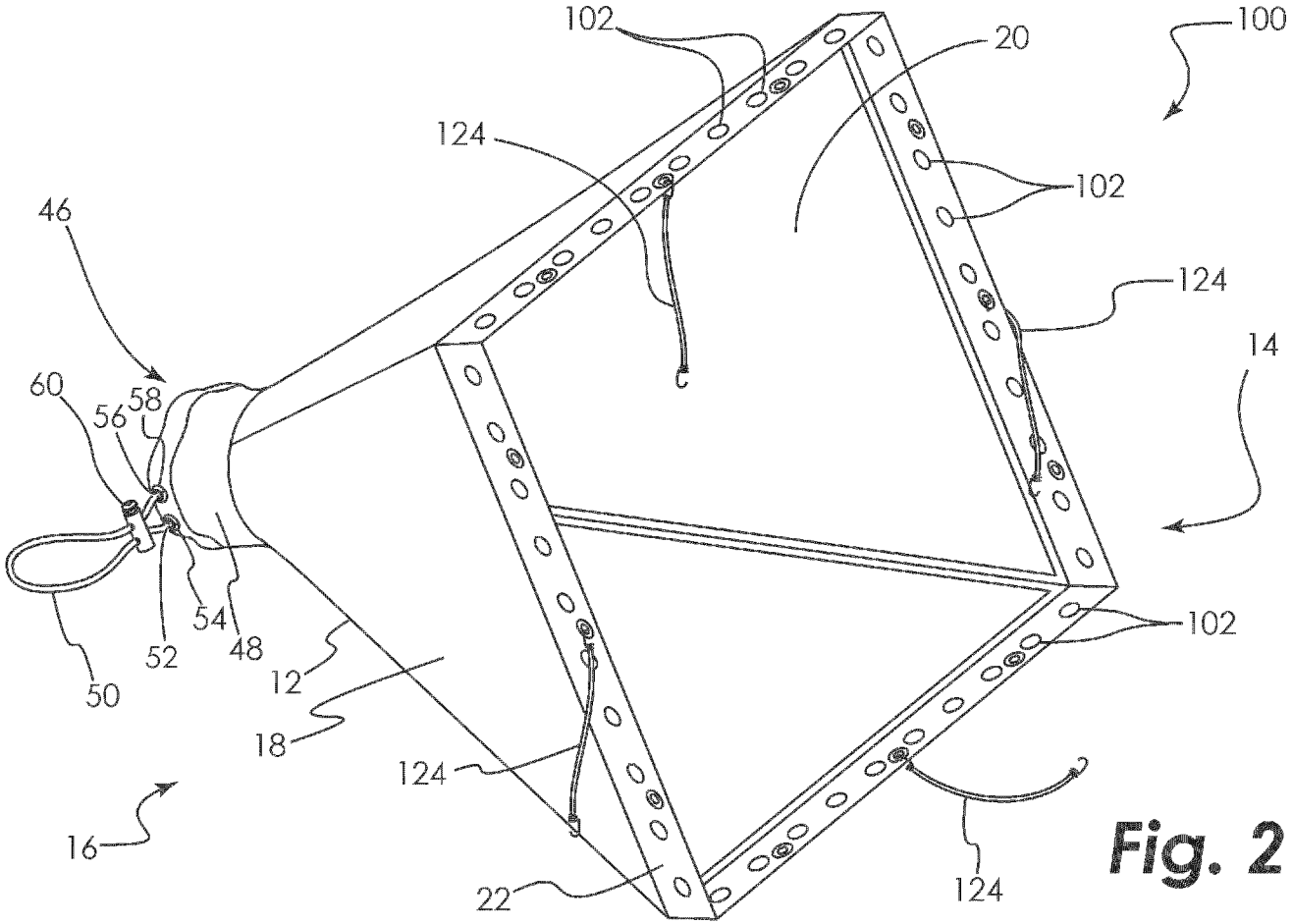
FIG. 2 is a perspective view of a second embodiment cleaning device according to the present invention.

A second embodiment device is illustrated in FIG. 2 and indicated generally at 100. The device 100 is designed to attach magnetically to a flat framed refrigeration coil unit, therefore it contains a plurality of magnets 102 attached to the first end 14 of the bag 12. In the illustrated embodiment, the magnets 102 are secured within the internal passageway of the coupler 22; however, those skilled in the art will recognize that the magnets 102 may be coupled to the device 100 in any desired manner. The magnets 102 easily attach to the edges of flat-framed refrigeration coil units (not shown) and hold the device 100 in place. Optional bungee cords 124 may be attached to the first end 14 of the bag 12 in order to provide an additional means for securing the bag 12 to the refrigeration coils. In other respects, the construction details of the second embodiment are similar to the first embodiment.

A third embodiment device is illustrated in FIG. 5 and indicated generally at 200. In FIG. 5, the device 200 is illustrated looking into the first end 14 of the bag 12. The device 200 is substantially identical to either the device 10 or the device 100, and is further enhanced by the inclusion of baffles 202 in the interior of the bag 12. As shown in greater detail in FIG. 6, one or more baffles 202 may be used. In the illustrated embodiment there are four baffles 202*a-d*. The use of four baffles may be advantageous with a four-sided square bag 12, but those skilled in the art will recognize from the present disclosure that a greater or fewer number of baffles may be used. The baffles 202*a-d* are shaped to fit within the interior of the bag 12 and are coupled thereto by any convenient means, such as by sewing. Additionally, in the configuration of FIG. 5, the baffles 202*a-d* are coupled to one another by any convenient means, such as by sewing. In some embodiments, the baffles 202*a-d* are formed from 20 gauge vinyl. In some embodiments, baffles 202*a* and 202*d* are formed from a single piece, as are baffles 202*b* and 202*c*, and the two pieces are sewn together along their centerlines as shown. The baffles 202*a-d* form respective chambers 204*a-d* therebetween. The chambers 204*a-d* enhance the scavenging effect of the vacuum by more directly funneling dirt and debris toward the vacuum source.

Figure 7:
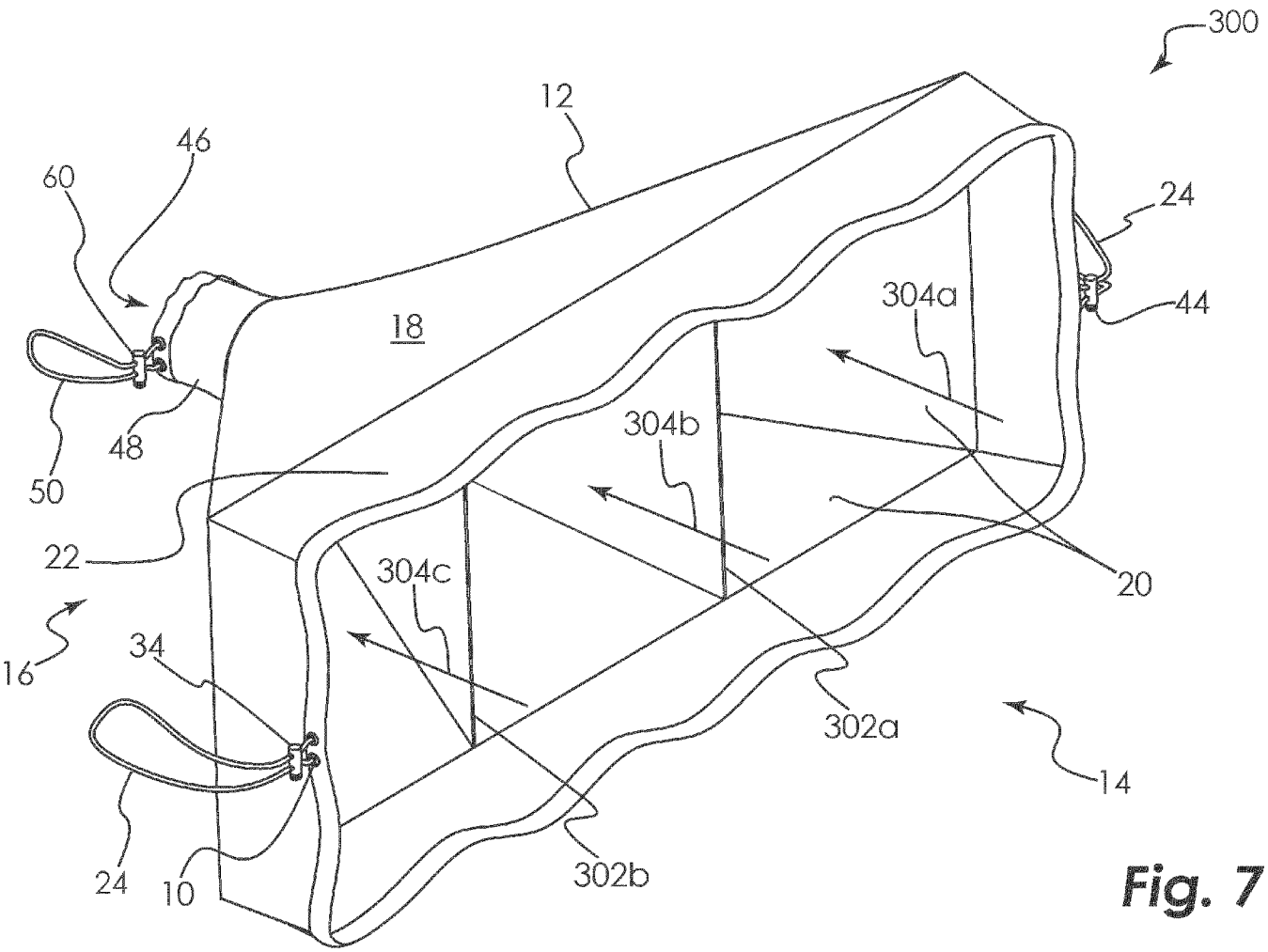
FIG. 7 is a perspective view of a fourth embodiment cleaning device according to the present invention.
Figure 8:
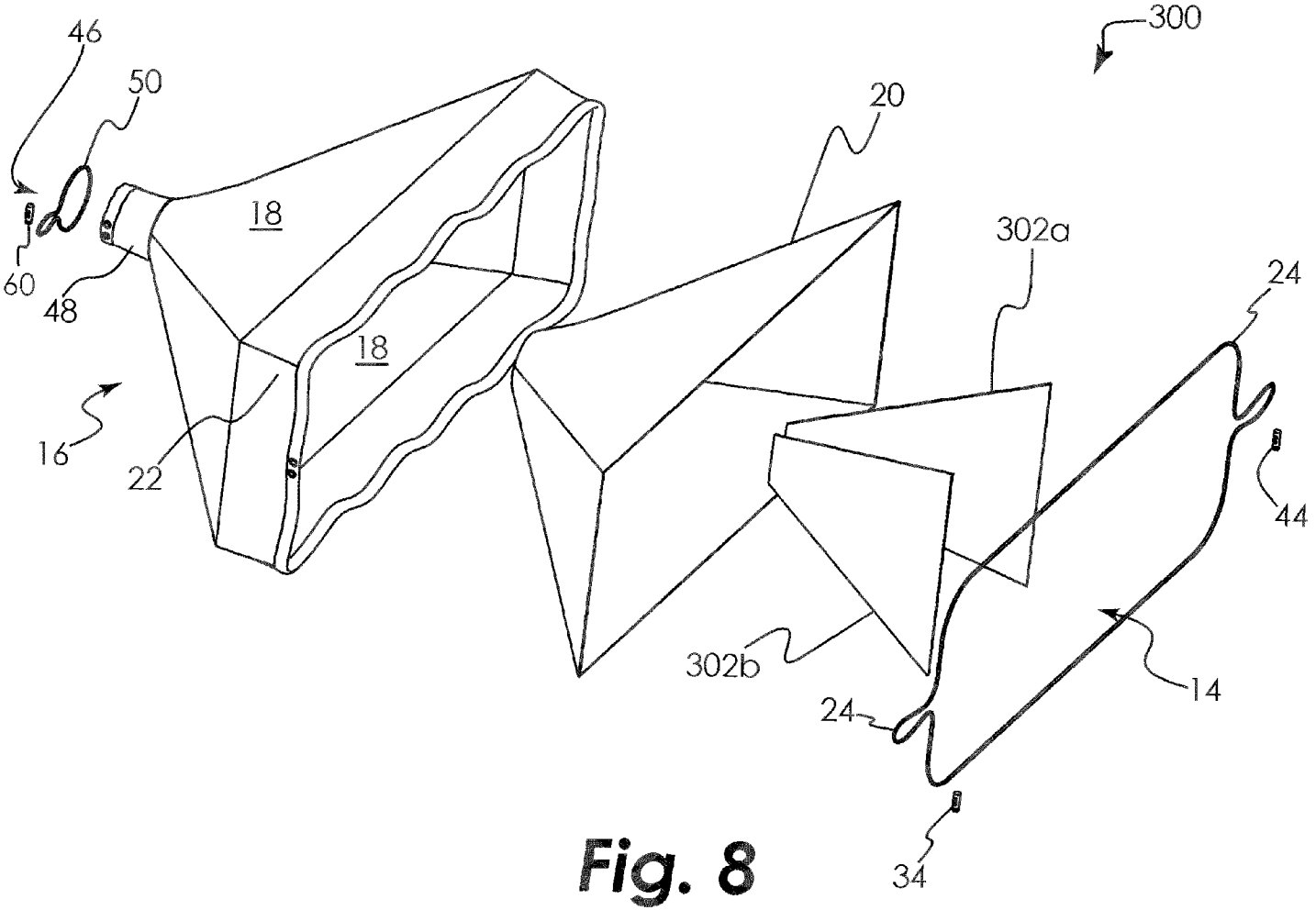
FIG. 8 is an exploded view of the fourth embodiment cleaning device of FIG. 7.

FIGS. 7-8 illustrate yet another embodiment, indicated generally at 300. The device 300 is similar to the device 10 and the device 100. In the illustrated embodiment, it has dimensions that form it into a rectangular cross-sectional shape. The interior of the bag 12 contains baffles 302*a* and 302*b*. In the illustrated embodiment there are two baffles. Those skilled in the art will recognize from the present disclosure that a greater or fewer number of baffles may be used. The baffles 302*a-b* are shaped to fit within the interior of the bag 12 and are coupled thereto by any convenient means, such as by sewing. In some embodiments, the baffles 302*a-b* are formed from 20 gauge vinyl. The baffles 302*a-b* form respective chambers 304*a-c* therebetween. As with the embodiment of FIGS. 5-6, the chambers 304*a-c* enhance the scavenging effect of the vacuum by more directly funneling dirt and debris toward the vacuum source.

In use, the technician slides out the refrigeration coil from the unit to expose the coil for service. Then, the technician attaches the bag 12 (large end) to the front of the coil unit, and pulls the cinch cord 24 to secure bag around the coil frame. In the case of the second embodiment, the bag may be held in place by means of the magnets 102 alone, or further secured with the optional cord 24. Next, the technician attaches any size vacuum hose to the second end 46 of the bag 12, and pulls cord 50 at that end to secure the bag 12 to the vacuum hose (not shown). The technician then turns on the vacuum and directs a source of compressed gas and/or liquid through the back side of the refrigeration coil unit. The bag catches and funnels all dust and debris dislodged from the coils into the vacuum, including any liquid cleaning solution (if used).

Cleaning the refrigeration coil thoroughly has the following positive effects:

1. Minimizes transmission of dirt, dust and debris caused by cleaning (blowing out) refrigerant coils to the surrounding area.
2. Cuts down on labor time by minimizing clean-up time required after cleaning the coils.
3. Refrigeration units will run more efficiently when properly cleaned.
4. Prolongs the life of the refrigeration units.
5. Clean coils result in less costly future repairs.

It will be appreciated by those skilled in the art after reviewing the present disclosure that the presently disclosed embodiments could also be used to clean other items. For example, the presently disclosed embodiments may be used to clean computers or other electronic devices by cinching the first side 14 opening over one side of the device prior to cleaning. An additional example is use of the device for cleaning HVAC ducts. The magnetic couplers 102 of the second embodiment device may be adhered to an opening at the furnace or another location on the duct work, so that debris from the ducts may be vacuumed through the device. Another example is use of the device during the sweeping of chimneys. The device may be placed over the fireplace opening, either by use of the magnetic couplers 102 on a metal fireplace surround or by any other convenient coupling means, such as taping, so that debris from the chimney sweeping process may be vacuumed and thereby prohibited from entering the room in which the fireplace is located. These are non-limiting examples, and those skilled in the art will recognize from the present disclosure that many other similar uses may be made of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Specifically, various steps in disclosed sequences may be executed in different orders than specified in the disclosed embodiments.

What is claimed is:

1. A system, comprising:
an object to be cleaned;
a vacuum source;
a bag having a first open end, a center section, and a second open end;
a first coupler at said first open end coupling said first open end to said object to be cleaned;
a second coupler at said second open end coupling said second open end to said vacuum source;
at least one baffle disposed inside said center section, wherein said at least one baffle forms a plurality of chambers within said bag; and
a stiffener coupled to said bag.

2. The system of claim 1, wherein said at least one baffle is formed from vinyl.

3. The system of claim 1, wherein:
said at least one baffle comprises four baffles;
each of said four baffles includes a first side coupled to said center section and a second side coupled to every other said baffle.

4. The system of claim 3, wherein said four baffles comprise:
a first baffle sheet folded along a first longitudinal axis; and
a second baffle sheet folded along a second longitudinal axis;
wherein said first and second baffle sheets are coupled along said first and second longitudinal axes.

5. The system of claim 1, wherein:
said at least one baffle comprises two baffles;
each of said two baffles includes a first side coupled to said center section and a second side coupled to said center section.

6. The system of claim 1, wherein said stiffener is disposed inside said bag.

7. The system of claim 1, wherein said first coupler comprises:
a first passage formed through said first open end;
a first opening in said first passage;
a second opening in said first passage; and
a first cord;
wherein said first cord enters said first passage through said first opening and exits said first passage through said second opening.

8. The system of claim 7, further comprising a first drum cord stop coupled to said cord.

9. The system of claim 1, wherein said second coupler comprises:
a second passage formed through said second open end;
a third opening in said second passage;
a fourth opening in said second passage; and
a second cord;

wherein said second cord enters said second passage through said third opening and exits said second passage through said fourth opening.

10. The system of claim 9, further comprising a second drum cord stop coupled to said second cord.

11. The system of claim 1, wherein said first coupler comprises a plurality of magnets coupled to said first open end.

12. A system, comprising:

an object to be cleaned;

a vacuum source;

a bag having a first open end, a center section, and a second open end;

a stiffener coupled to said bag;

a first coupler at said first open end coupling said first open end to said object to be cleaned;

a second coupler at said second open end coupling said second open end to said vacuum source; and an at least one baffle disposed inside said center section, wherein said at least one baffle forms a plurality of chambers within said bag.

13. The system of claim 12 wherein said bag is formed from 10 oz. cotton duck cloth.

14. The system of claim 12, wherein said bag has an approximately square transverse cross-sectional shape.

15. The system of claim 14, wherein each side of said square is approximately 20 inches.

16. The system of claim 12, wherein said center section is formed from four panels of cloth sewn together.

17. The system of claim 12, wherein said stiffener is disposed inside said bag.

18. The system of claim 12, wherein said stiffener comprises 20 gauge vinyl.

19. The system of claim 12, wherein said first coupler comprises:

a first passage formed through said first open end;

a first opening in said first passage;

a second opening in said first passage; and a first cord;

wherein said first cord enters said first passage through said first opening and exits said first passage through said second opening.

20. The system of claim 19, further comprising a first drum cord stop coupled to said cord.

21. The system of claim 12, wherein said second coupler comprises:

a second passage formed through said second open end;

a third opening in said second passage;

a fourth opening in said second passage; and a second cord;

wherein said second cord enters said second passage through said third opening and exits said second passage through said fourth opening.

22. The system of claim 21, further comprising a second drum cord stop coupled to said second cord.

23. The system of claim 12, further comprising a plurality of magnets coupled to said first open end.

24. The system of claim 12, wherein said at least one baffle is formed from vinyl.

* * * * *